US009635746B2

(12) United States Patent
Min et al.

(10) Patent No.: US 9,635,746 B2
(45) Date of Patent: Apr. 25, 2017

(54) DETECTING CIRCUIT FOR OPEN OF LED ARRAY AND LED DRIVER APPARATUS USING THE SAME

(71) Applicant: Magnachip Semiconductor, Ltd., Cheongju-si (KR)

(72) Inventors: Jun-sik Min, Cheongju-si (KR); Tae-kyoung Kang, Cheongju-si (KR); Beom-seon Ryu, Cheongju-si (KR)

(73) Assignee: Magnachip Semiconductor, Ltd., Cheongju-si (KR)

( * ) Notice: Subject to any disclaimer, the term of this patent is extended or adjusted under 35 U.S.C. 154(b) by 497 days.

(21) Appl. No.: 13/693,516

(22) Filed: Dec. 4, 2012

(65) Prior Publication Data

US 2013/0147355 A1 Jun. 13, 2013

(30) Foreign Application Priority Data

Dec. 7, 2011 (KR) ..... 10-2011-0130464

(51) Int. Cl.
*H05B 33/08* (2006.01)
*H05B 37/03* (2006.01)

(52) U.S. Cl.
CPC ..... *H05B 37/03* (2013.01); *H05B 33/0827* (2013.01); *H05B 33/0887* (2013.01)

(58) Field of Classification Search
CPC ..... H01L 2924/3011; H01L 2924/00; H05B 33/0815; H05B 33/0827; H05B 33/0809; H05B 33/0824; H05B 33/089
USPC ..... 315/88–91, 119, 121–128, 185 R, 192, 315/209 R, 210, 225, 291, 294, 307–308, 315/312, 320, 361–362
See application file for complete search history.

(56) References Cited

U.S. PATENT DOCUMENTS

| | | | | |
|---|---|---|---|---|
| 7,329,994 | B2 | 2/2008 | Toda et al. | |
| 2006/0082332 | A1* | 4/2006 | Ito et al. | 315/291 |
| 2009/0021185 | A1* | 1/2009 | Ng | 315/294 |
| 2010/0084990 | A1* | 4/2010 | Ang et al. | 315/291 |
| 2011/0309758 | A1* | 12/2011 | Yu et al. | 315/192 |
| 2012/0119653 | A1* | 5/2012 | Bianco | H05B 33/0818 315/127 |
| 2012/0206047 | A1* | 8/2012 | Vos | 315/122 |

FOREIGN PATENT DOCUMENTS

| | | |
|---|---|---|
| CN | 100531491 C | 8/2009 |
| KR | 10-0859562 | 9/2008 |

OTHER PUBLICATIONS

Taiwanese Office Action issued on Jul. 11, 2016 in counterpart Taiwanese Patent Application No. 101144824 (14 pages, in Chinese).

* cited by examiner

*Primary Examiner* — Douglas W Owens
*Assistant Examiner* — Jianzi Chen
(74) *Attorney, Agent, or Firm* — NSIP Law

(57) ABSTRACT

A detecting circuit and method thereof are configured to detect whether an LED array is open is described. The detecting circuit includes a resistance unit, a first switching unit, and an output unit. The resistance unit is operatively connected in series to the LED array. The switching unit is configured to be turned on when a voltage of the resistance unit is greater than or equal to a predetermined voltage level. The output unit is configured to produce an output indicative of whether the LED array is open, based whether the first switching unit is turned on.

21 Claims, 10 Drawing Sheets

If current flows in LED string

If current does not flow in LED string

If current flows in LED string

If current does not flow in LED string

If current flows in LED strings 1 and 2

If current flows in LED string 1 and current does not flow in LED string 2

DETECTING CIRCUIT FOR OPEN OF LED ARRAY AND LED DRIVER APPARATUS USING THE SAME

CROSS-REFERENCE TO RELATED APPLICATION

This application claims priority from Korean Patent Application No. 10-2011-0130464, filed on Dec. 7, 2011 in the Korean Intellectual Property Office, the disclosure of which is incorporated herein by reference in its entirety.

BACKGROUND

1. Field

The following description relates to detecting whether a light emitting diode (LED) array is open, and more particularly, to a detecting circuit configured to detect whether an LED array is open and an LED driver method and apparatus using the same.

2. Description of the Related Art

A liquid crystal display (LCD) is widely used because it is thin and light in weight when compared to other displays and requires a low driving voltage and low power consumption. However, because the LCD is a non-emissive element that cannot emit light by itself, it requires a separate backlight source to supply light to an LCD panel.

As a backlight source for the LCD, a cold cathode fluorescent lamp (CCFL) and a light emitting diode (LED) are mostly used. The CCFL, however, may cause environmental pollution because it uses mercury. Also, the CCFL includes slow response time and low color reproducibility and is not helpful for the LCD panel to be light in weight, thin, short, and small.

On the other hand, the LED is eco-friendly because it does not use environmentally harmful materials and is capable of achieving impulse driving. Also, the LED has good color reproducibility and can change brightness or color temperature arbitrarily by adjusting an amount of light emitted from red, green, and blue light emitting diodes. The LED has further advantages suitable for a light, thin, short, and small configuration for the LCD panel. Thus, in recent years, the LED has been frequently used as a backlight source for the LCD panel.

LED arrays include a plurality of LEDs and are operatively connected to one another. When LED arrays are used in the LCD backlight unit, a driving circuit is needed to provide a constant current to each of the LED arrays, and a dimming circuit is also needed to adjust brightness and color temperature arbitrarily or compensating for overheating.

An electrical shock may disconnect the LED arrays from an LED driver by opening one or more of the connections in the LED arrays. In this case, a protection circuit to detect the opening of the LED array is needed.

However, the protection circuit may connect a diode to an end of the LED array and detect whether the LED array is open or not depending on whether the diode conducts electricity or not. However, such protection circuit may wrongfully detect that the LED array is open when an abnormal feedback voltage occurs due to initial driving or a peak current of a constant current.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In accordance with an illustrative example, a detecting circuit is configured to detect whether an LED array is open. The detecting circuit includes a resistance unit operatively connected in series to the LED array; a first switching unit configured to be turned on when a voltage of the resistance unit is greater than or equal to a predetermined voltage level; and an output unit configured to produce an output indicative of whether the LED array is open, based on whether the first switching unit is turned on.

The first switching unit maintains a turn-off state preventing a current from flowing when the LED array is open.

The detecting circuit detects the LED array to be open when a constant current does not flow through the LED array, current does not flow through the resistance unit, and the first switching unit is turned off.

The first switching unit is a P-type bipolar junction transistor (BJT). An emitter of the P-type BJT is commonly connected to the LED array and one end of the resistance unit, a base of the P-type BJT is operatively connected to another end of the resistance unit, and a collector of the P-type BJT is grounded through a second resistance. The predetermined voltage level is a threshold voltage of the P-type BJT.

A resistance value of the resistance unit is greater than or equal to a value obtained by dividing the threshold voltage of the P-type BJT by a constant current flowing through the LED array.

A second switching unit is configured to be turned on in response to the first switching unit being turned on. The output unit is configured to produce an output indicating whether the LED array is open based on whether the second switching unit is turned on.

The second switching unit is an N-type bipolar junction transistor (BJT). An emitter of the N-type BJT is grounded, a base of the N-type BJT is operatively connected to the collector of the P-type BJT, and a collector of the N-type BJT is operatively connected to a voltage source through a third resistance.

A second resistance is disposed between the first switching unit and ground, and a resistance value of the second resistance is greater than or equal to a value obtained by dividing a threshold voltage of the N-type BJT by a current of the collector of the P-type BJT.

When a constant current does not flow through the LED array, current does not flow through the resistance unit, the first switching unit is turned off, the second switching unit is turned off, and the output unit is configured to output a high voltage value (VDD) indicative that the LED array is open.

The detecting circuit detects whether LED arrays are open, the resistance unit includes resistances operatively and respectively connected in series to the LED arrays, the first switching unit includes a switching elements operatively and respectively connected to the resistances of the resistant unit, and the output unit is configured to produce an output indicating that an open LED array exists when at least one of the switching elements is turned off.

In accordance with another illustrative example, an LED driver apparatus, includes an LED array; an LED driving circuit configured to provide a driving voltage and a constant current to the LED array; a resistance unit operatively connected in series to the LED array; and a detecting unit configured to detect whether the LED array is open based on a voltage of the resistance unit.

The detecting unit includes the resistance unit; a first switching unit configured to be turned on when the voltage of the resistance unit is greater than or equal to a predetermined voltage level; and an output unit configured to produce an output indicating whether the LED array is open based on whether first switching unit is turned on.

The first switching unit maintains a turn-off state when the LED array is open and a current does not flow.

The first switching unit is a P-type bipolar junction transistor (BJT). An emitter of the P-type BJT is commonly connected to the LED array and one end of the resistance unit, a base of the P-type BJT is operatively connected to another end of the resistance unit, and a collector of the P-type BJT is grounded through a second resistance. The predetermined voltage level is a threshold voltage of the P-type BJT.

A resistance value of the resistance unit is greater than or equal to a value obtained by dividing the threshold voltage of the P-type BJT by a constant current flowing through the LED array.

The detecting unit further includes a second switching unit configured to be turned on in response to the first switching unit being turned on. The output unit is configured to produce an output indicating whether the LED array is open based on whether the second switching unit is turned on.

The second switching unit is an N-type bipolar junction transistor (BJT). An emitter of the N-type BJT is grounded, a base of the N-type BJT is operatively connected to the collector of the P-type BJT, and a collector of the N-type BJT is operatively connected to a voltage source through a third resistance.

A second resistance is disposed between the first switching unit and ground, and a resistance value of the second resistance is greater than or equal to a value obtained by dividing a threshold voltage of the N-type BJT by a current of the collector of the P-type BJT.

The LED driver apparatus includes LED array. The resistance unit includes resistances operatively and respectively connected in series to the LED arrays. The first switching unit includes a switching elements operatively and respectively connected to the resistances of the resistant unit. The output unit is configured to produce an output indicating that an open LED array exists when at least one of the switching elements is turned off.

The LED driver apparatus also includes a controller configured to stop operating the LED driving circuit when an opened LED array is detected.

As described above, because the detecting circuit to detect whether the LED array is open and the LED driver apparatus detects whether the LED array is open according to whether a current flows in the LED array or not, it can be precisely detected whether the LED array is open, regardless of an abnormal forward voltage.

BRIEF DESCRIPTION OF THE DRAWING FIGURES

The above and/or other aspects will be more apparent by describing in detail exemplary configurations, with reference to the accompanying drawings, in which.

DETAILED DESCRIPTION OF EXEMPLARY EMBODIMENTS

Figure 1:
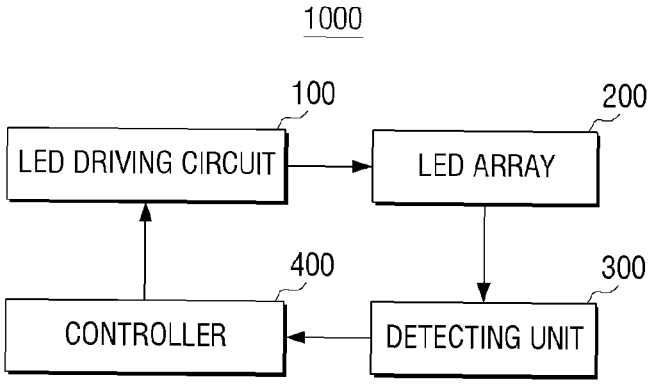
FIG. 1 is a block diagram illustrating an LED driver apparatus, according to an illustrative configuration.

Hereinafter, exemplary configurations will be described in greater detail with reference to the accompanying drawings.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness. Throughout the drawings and the detailed description, unless otherwise described, the same drawing reference numerals will be understood to refer to the same elements, features, and structures. The relative size and depiction of these elements may be exaggerated for clarity, illustration, and convenience.

It will be understood that when an element is referred to as being "on," "connected to," or "operatively connected to" another element or unit, it can be directly on or connected to another element or unit through intervening elements or units. In contrast, when an element is referred to as being "directly on" or "directly connected to" another element or layer, there are no intervening elements or layers present. Like reference numerals refer to like elements throughout. As used herein, the term "and/or" includes any and all combinations of one or more of the associated listed items. The units described herein may be implemented using hardware components. The hardware components may include, for example, controllers, processors, generators, drivers, resistors, filters, metal-oxide-semiconductor field-effect transistor (MOSFETs), metal-insulator-semiconductor FET (MISFETs), metal-oxide-semiconductors (MOSs), and other equivalent electronic components.

FIG. 1 is a block diagram illustrating an LED driver apparatus, according to an illustrative configuration.

Referring to FIG. 1, an LED driver apparatus 1000 includes an LED driving circuit 100, an LED array 200, a detecting unit 300, and a controller 400. The LED driver apparatus 1000 may be an image display apparatus, including, but not limited to, a monitor, a digital TV, a notebook computer, a mobile phone, an MP3 player, and a portable multimedia player (PMP).

The LED driving circuit 100 receives a dimming signal to drive the LED array 200 and provides a driving voltage and a constant current to the LED array 200 according to the received dimming signal. A detailed configuration of the LED driving circuit 100 is explained below with reference to FIG. 2.

The LED array 200 includes a plurality of LEDs which are operatively connected to one another. In one configuration, the LEDs in the LED array 200 are connected in series and perform a light emitting operation. The LED array 200 may be a single LED array or a plurality of LED arrays.

The detecting unit 300 measures and determines whether a current of a predetermined level is flowing through the LED array 200 to detect whether the LED array 200 is open. Specifically, if a current of a predetermined level flows through the LED array 200, the detecting unit 300 detects that the LED array 200 is normally connected and operating. On the other hand, if a current lower than the predetermined level flows, the detecting unit 300 detects that the LED array 200 is open. Accordingly, the detecting unit 300, according to an illustrative example, includes a resistance unit, which is connected to the LED array 200 in series, to detect the current flowing through the LED array 200. The resistance unit also detects whether the LED array 200 is open based on a measurement and detection of a predetermined voltage level of the resistance unit. Detailed configuration and operation of the detecting unit 300 will be explained below with reference to FIGS. 3 to 9.

The controller 400 controls the elements in the LED driver apparatus 1000. Specifically, the controller 400 generates a dimming signal to drive the LED array 200 and provides the dimming signal to the LED driving circuit 100. The controller 400 controls the detecting unit 300 to detect whether the LED array 200 is open. Specifically, the controller 400 provides a detecting circuit enable signal to the detecting unit 300. In response, the detecting unit 300 detects whether the LED array 200 is open. In one configuration, if the detecting unit 300 detects that the LED array 200 is open, the controller 400 stops driving the LED driving circuit 100.

As described above, because the LED driver apparatus 1000, according to one exemplary configuration, is configured to detect whether the LED array 200 is open using the current flowing in the LED array 200, the LED driver apparatus 1000 can accurately detect whether the LED array 200 is open, regardless of an occurrence of an abnormal feedback voltage.

Figure 2:
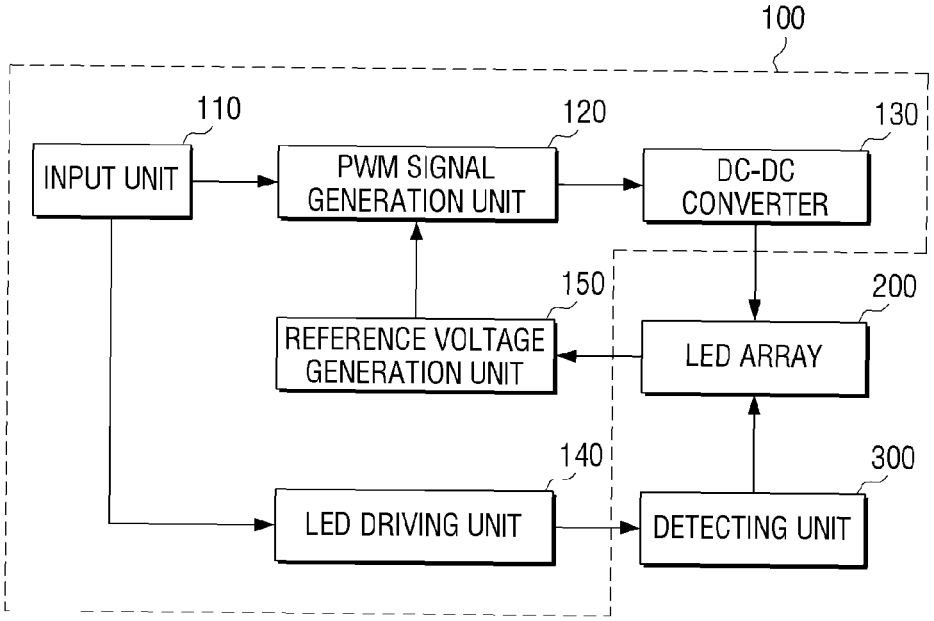
FIG. 2 is a block diagram illustrating an LED driving circuit, according to an illustrative configuration.

FIG. 2 is a block diagram illustrating the LED driving circuit of FIG. 1, according to an illustrative configuration.

Referring to FIG. 2, the LED driving circuit 100 includes an input unit 110, a pulse width modulation (PWM) signal generation unit 120, a direct current (DC)-DC converter 130, an LED driving unit 140, and a reference voltage generation unit 150.

The input unit 110 receives a dimming signal from the controller 400 to drive the LED array 200. Specifically, a direct mode, a fixed phase mode, and a phase shift mode may be used as digital dimming methods to generate the dimming signal to drive the LED array 200. The direct mode is a method that controls a PWM frequency and an on-duty signal through an external device (for example, a packet assembler/disassembler (PAD)). The fixed phase mode and the phase shift mode are methods that generate a PWM frequency through an internal integrated circuit (IC), and receive and control only the on-duty signal through the PAD. In one illustrative example, the dimming signal is a signal to adjust brightness and color temperature of the LED or to compensate for high temperatures. In the present exemplary configuration, the direct mode method in which the dimming signal is received from an external source is discussed. However, the controller 400 may be configured to use the fixed phase mode and/or the phase shift mode.

The PWM signal generation unit 120 generates a PWM signal according to a reference voltage. Specifically, the PWM signal generation unit 120 generates a PWM signal to control a level of a driving voltage of the DC-DC converter 130 according to a reference voltage generated by the reference voltage generation unit 150.

The DC-DC converter 130 includes a transistor to perform a switching operation, and provides a driving voltage to the LED array 200 according to the switching operation of the transistor. Specifically, the DC-DC converter 130 converts a DC voltage based on the PWM signal generated by the PWM signal generation unit 120, and provides the converted DC voltage, that is, the driving voltage, to the LED array 200. At this time, the DC-DC converter 130 provides a voltage corresponding to a forward bias voltage of the LED array 200 to the LED array 200 so that the LED array 200 is operated in a saturation area.

The LED driving unit 140 provides a constant current to drive the LED array 200 using the dimming signal from the input unit 110. Specifically, the LED driving unit 140 adjusts a level of a driving current in the LED array 200 using the dimming signal and provides the adjusted constant current, that is, the driving current, to the LED array 200.

The reference voltage generation unit 150 generates a reference voltage. Specifically, the reference voltage generation unit 150 measures a feedback voltage or a forward voltage of each of the LED arrays in the LED array 200. The reference voltage generation unit 150 provides a reference voltage that corresponds to an LED array having the lowest voltage from among the measured forward voltages of the LED arrays to the PWM signal generation unit 120. If the LED array 200 includes a single LED array, the reference voltage generation unit 150 measures the feedback voltage or the forward voltage of the single LED array and provides the measured voltage to the PWM signal generation unit 120.

In one configuration, the LED array may be detected to be open using a feedback voltage. However, the feedback voltage of the LED array may fall near to 0V temporarily due to a peak current of a constant current. If it is detected that the LED array is open using the feedback voltage as described above, the LED array may be mistakenly recognized as being open, even if it is not open in actuality.

Because the detecting unit 300 according to the illustrative configuration detects whether the LED array 200 is open based on the level of the current flowing in the LED array 200, the problem of mistakenly recognizing that the LED array is open can be solved.

However, because it is difficult to directly detect a value of the current flowing through the LED array 200, a resistance is connected to the LED array 200 in series. The value of the current flowing through the LED array 200 may be obtained at the detecting unit 300 based on a value of a voltage exerted to the resistance connected in series, that is, by dividing the voltage value of the resistance by a resistance value. Thus, the detecting unit 300 can detect whether a current greater than a predetermined current level flows in the LED array 200. The detecting unit 300 may be realized in three types, which will be described below.

Although only three illustrative configurations are discussed, the detecting unit 300 may be realized by other circuit constitutions to detect a level of a current flowing in the LED array 200.

Figure 3:
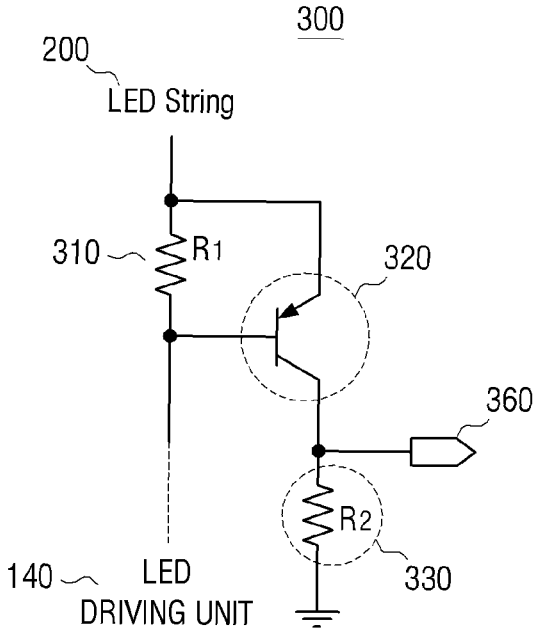
FIG. 3 is a circuit diagram illustrating a detecting unit, according to a first illustrative configuration.

FIG. 3 is a circuit diagram of the detecting unit 300, according to an illustrative configuration.

Referring to FIG. 3, the detecting unit 300 includes a resistance unit 310, a first switching unit 320, a second resistance 330, and an output unit 360.

The resistance unit 310 includes a first resistance, $R_1$, which is connected to the LED array or LED string 200 in series. Specifically, one end of the first resistance, $R_1$, of the resistance unit 310 is operatively connected to the LED array 200 and the other end is operatively connected to the LED driving unit 140, which provides a constant current. Although the first resistance, $R_1$, of the resistance unit 310 is operatively connected to a lower end of the LED array 200 in the example shown in FIG. 3, the first resistance, $R_1$, of the resistance unit 310 may be operatively connected to an upper portion of the LED array 200 in series or may be operatively connected to an intermediate portion of the LED array 200 in series. Also, although the resistance unit 310 includes only one resistance, $R_1$, as shown in FIG. 3, the resistance unit 310 may be realized using a plurality of resistances.

The first switching unit 320 includes a switching element that is turned on when a voltage of the resistance unit 310 is greater than or equal to a predetermined voltage level. The switching element of the first switching unit 320 may be a P-type bipolar junction transistor (BJT). In this case, an emitter of the P-type BJT may be commonly connected to the LED array 200 and one end of the resistance unit 310, a base of the P-type BJT may be operatively connected to the other end of the resistance unit 310, and a collector of the P-type BJT may be grounded through the second resistance 330. In one example, the predetermined voltage level is a threshold voltage of the P-type BJT being used. Accordingly, a resistance value of the first resistance may be set to be greater than or equal to a value that is obtained by dividing the threshold voltage of the P-type BJT by a constant current flowing through the LED array 200.

Although the first switching unit 320 is realized by the P-type BJT in the illustrative example of FIG. 3, the first switching unit 320 may be realized using other switching elements such as a MOS switch.

The output unit 360 outputs a voltage indicating whether the LED array 200 is open depending on whether the first switching unit 320 is turned on. Specifically, the output unit 360 is operatively connected to a node that is commonly connected to the first switching unit 320 and the second resistance 330. In the exemplary embodiment of FIG. 3, if it is detected that the LED array 200 is open, the first switching unit 320 is turned off and the output unit 360 outputs a voltage of a low electric potential (for example, 0V). If it is detected that the LED array 200 is not open, the first switching unit 320 is turned off and the output unit 360 outputs a voltage of a high electric potential (for example, 5V).

The operation of the detecting unit 300 according to the first illustrative configuration will be explained below with reference to FIGS. 4A and 4B.

Figure 4A:
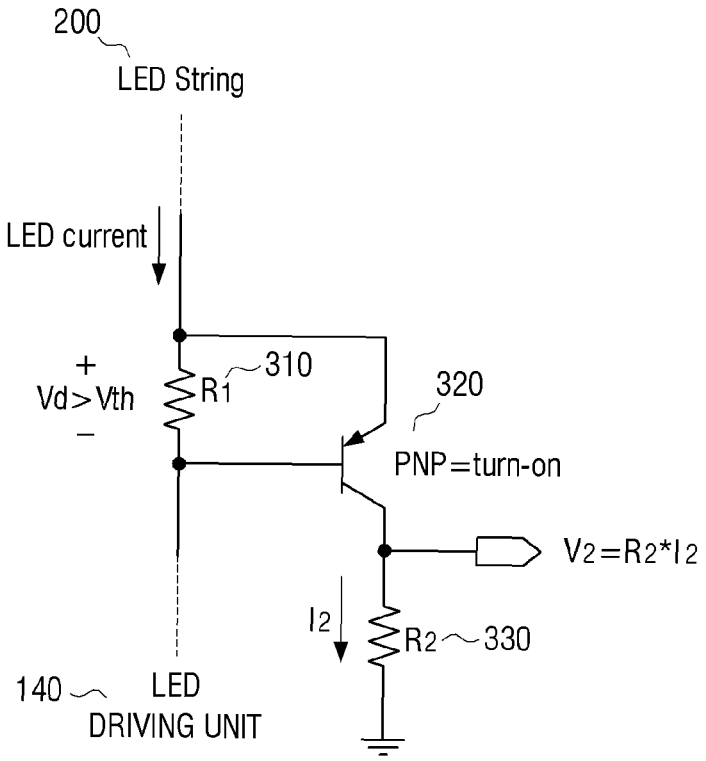
FIGS. 4A and 4B illustrate an operation of the detecting unit, according to the first illustrative configuration.
Figure 4B:
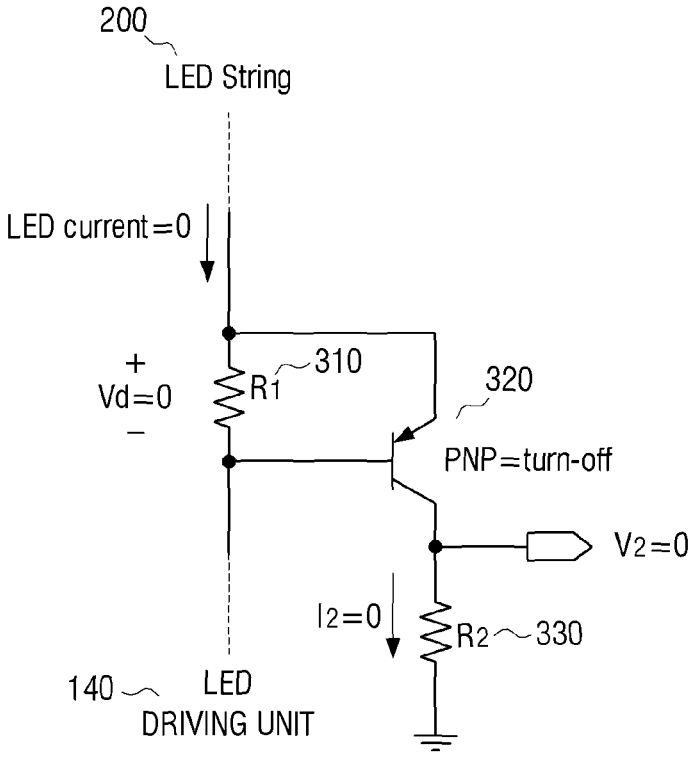

FIGS. 4A and 4B are views to explain the operation of the detecting unit 300, according to the first illustrative example. Specifically, FIG. 4A is a view to explain the operation of the detecting unit 300 when the LED array 200 is normally operating, and FIG. 4B is a view to explain the operation of the detecting unit 300 when the LED array 200 is open.

Referring to FIG. 4A, the LED array 200 is normally operating. When the LED array 200 is normally operating or closed, a constant current flows through the LED array 200 and the constant current also flows through the resistance unit 310 operatively connected to the LED array 200 in series. Accordingly, a voltage exerted to the resistance unit 310 is greater than the threshold voltage of the first switching unit 320. The first switching unit 320 is turned on and a voltage of the second resistance 330 has a voltage value of a predetermined level ($V_2=R_2*I_2$). As a result, the output unit 360 may output the voltage value of the predetermined level indicating that the LED array 200 is not open or closed.

Referring to FIG. 4B, the LED array 200 is open. When the LED array 200 is open, a constant current does not flow in the LED array 200 and, thus, a current does not flow through the resistance of the resistance unit 310 and the first switching unit 320 is turned off. Accordingly, the voltage of the second resistance 330 is 0V. The output unit 360 outputs a low voltage value (for example, 0V) indicating that the LED array 200 is open.

As described above, because the detecting unit 300 can detect whether the LED array 200 is open based on whether a current flows through the LED array 200 or not, the detecting unit 300 can precisely detect whether the LED array 200 is open, regardless of an abnormal forward voltage.

Figure 5:
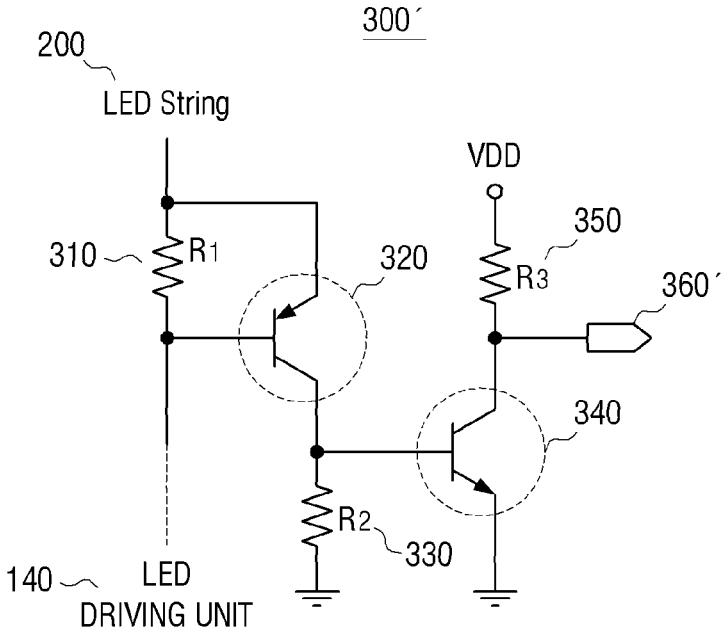
FIG. 5 is a circuit diagram illustrating a detecting unit, according to a second illustrative configuration.

FIG. 5 is a circuit diagram of a detecting unit, according to a second illustrative configuration.

Referring to FIG. 5, a detecting unit 300' includes a resistance unit 310, a first switching unit 320, a second resistance 330, a second switching unit 340, a third resistance 350, and an output unit 360'.

The resistance unit 310 includes a first resistance, $R_1$, which is operatively connected to the LED array or LED string 200 in series. In one example, one end of the first resistance of the resistance unit 310 is operatively connected to the LED array 200 and the other end is operatively connected to the LED driving unit 140, which provides a constant current. Although the resistance unit 310 is operatively connected to a lower end of the LED array 200 in the present illustrative example, the resistance unit 310 may be operatively connected to an upper portion of the LED array 200 in series or may be operatively connected to an intermediate portion of the LED array 200 in series.

The first switching unit 320 includes a switching element that is turned on when a voltage of the resistance unit 310 is greater than or equal to a predetermined voltage level. The switching element may be a P-type BJT. In this case, an emitter of the P-type BJT is commonly connected to the LED array 200 and one end of the resistance unit 310, a base of the P-type BJT is connected the other end of the resistance unit 310, and a collector of the P-type BJT is grounded through the second resistance 330. In one example, the predetermined voltage level is a threshold voltage of the P-type BJT. Accordingly, a resistance value of the first resistance may be set to be greater than or equal to a value that is obtained by dividing the threshold voltage of the P-type BJT by a constant current flowing through the LED array 200.

The second resistance 330 is disposed between the first switching unit 320 and ground. Although only one resistance, $R_2$, is illustrated in the present illustrative example, the second resistance 330 may be configured using a plurality of resistances.

The second switching unit 340 may be turned on before, after, or simultaneously with the first switching unit 320. The second switching unit 340 may be an N-type BJT. In this case, an emitter of the N-type BJT may be grounded, a base of the N-type BJT may be commonly connected to the collector of the P-type BJT and the second resistance 330, and a collector of the N-type BJT may be a connected to a voltage source (VDD) through the third resistance 350. In one example, the voltage (V2 voltage) of the collector of the P-type BJT is greater than the threshold voltage of the N-type BJT when the P-type BJT is turned on. As a result, the N-type BJT is turned on in response to the turn-on of the P-type BJT. A resistance value of the second resistance 330 may be set to be greater than or equal to a value that is obtained by dividing the threshold voltage of the N-type BJT by a current through the collector of the P-type BJT.

Although the second switching unit 340 is configured using the N-type BJT in the illustrative example of FIG. 5, the second switching unit 340 may be configured using other switching elements.

The output unit 360' produces an output indicating whether the LED array 200 is open based on whether the second switching unit 340 is turned on. Specifically, the output unit 360' is operatively connected to a node that is commonly connected to the second switching unit 340 and the third resistance 350. In the exemplary embodiment of FIG. 5, if the LED array 200 is open, the output unit 360' outputs a voltage of a high electric potential (for example, 5V). If the LED array 200 is normally operating, the output unit 360' outputs a voltage of a low electric potential (for example, 1V).

The operation of the detecting unit 300 according to the second illustrative configuration will be explained below with reference to FIGS. 6A and 6B.

Figure 6A:
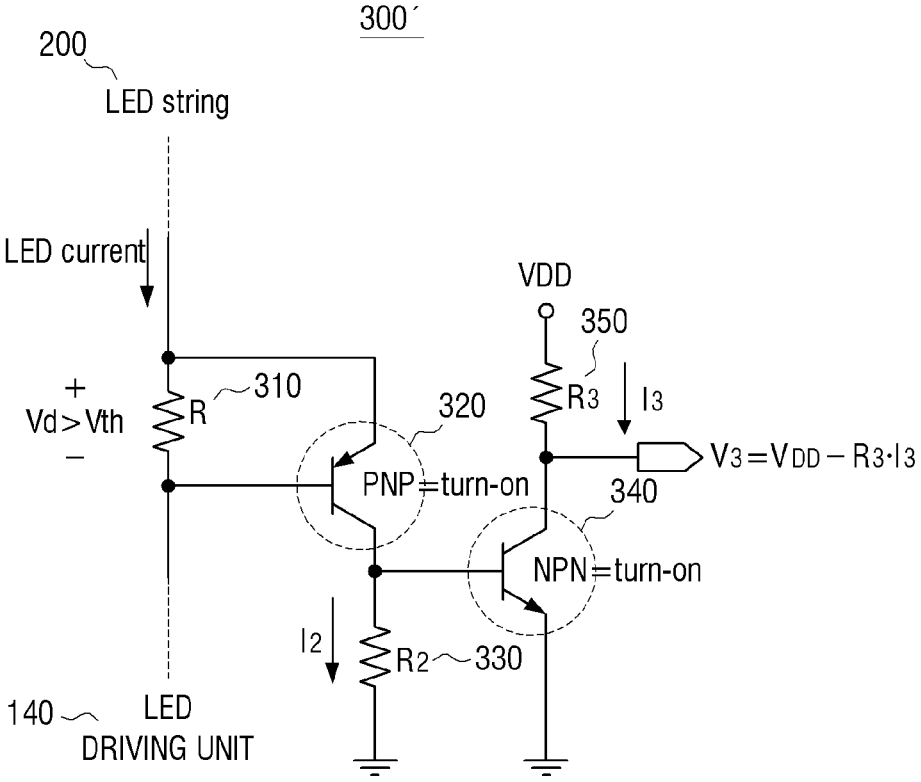
FIGS. 6A and 6B illustrate an operation of the detecting unit, according to the second illustrative configuration.
Figure 6B:
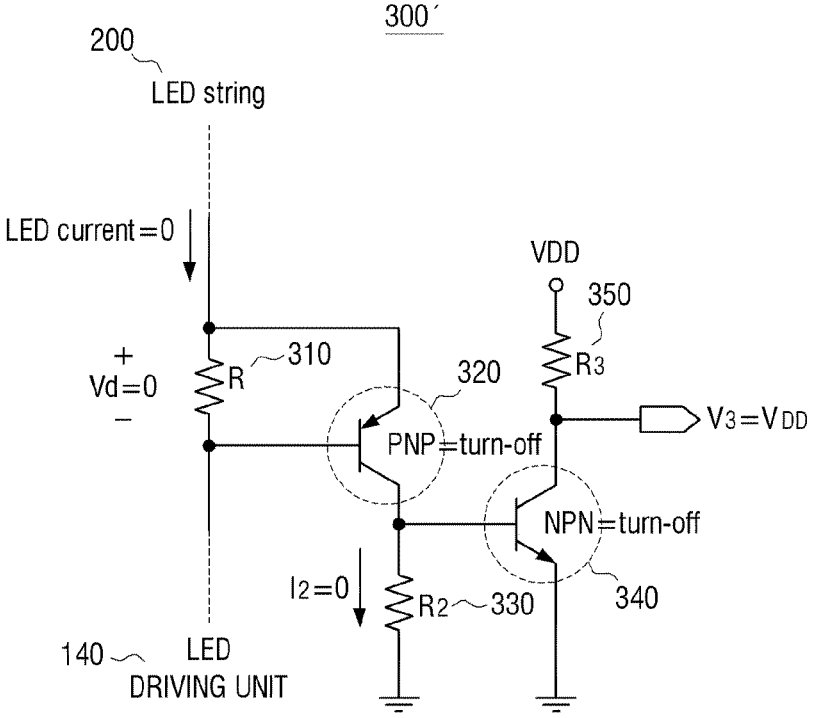

FIGS. 6A and 6B are views to explain the operation of the detecting unit 300' according to the second illustrative configuration. Specifically, FIG. 6A illustrates the operation of the detecting unit 300' when the LED array 200 is normally operating. FIG. 6B illustrates the operation of the detecting unit 300' if the LED array 200 is open.

Referring to FIG. 6A, the LED array 200 is normally operating. Accordingly, a constant current flows through the LED array 200 and a constant current also flows through the resistance unit 310. As a result, a voltage exerted to the resistance unit 310 is greater than the threshold voltage of the first switching unit 320. The first switching unit 320 is turned on and a voltage of the collector of the first switching unit 320, that is, a voltage of the second resistance, $R_2$, has a voltage value of a predetermined level ($V_2=R_2*I_2$). Accordingly, the second switching unit 340 is turned on and the output unit 360 outputs a low voltage value ($VDD-R_3*I_3$) indicating that the LED array 200 is not open.

Referring to FIG. 6B, the LED array 200 is open. Accordingly, a constant current does not flow through the LED array 200 and a constant current does not flow through the resistance unit 310. Therefore, the first switching unit 320 is turned off. That is, a voltage of the collector of the first switching unit 320, or a voltage of a second resistance, $R_2$, is 0V. Accordingly, the second switching unit 340 is turned off and the output unit 360 outputs a high voltage value (VDD) indicative that the LED array 200 is open.

As described above, the detecting unit 300' according to an illustrative configuration detects whether the LED array 200 is open based on whether a current flows in the LED array 200. As a result, the detecting unit 300' can precisely detect whether the LED array 200 is open, regardless of an abnormal forward voltage.

Although it is detected whether one LED array is open in the illustrative examples described, the detecting unit 300 may detect whether a plurality of LED arrays are open. This will be further explained below with reference to FIGS. 7 to 9.

Figure 7:
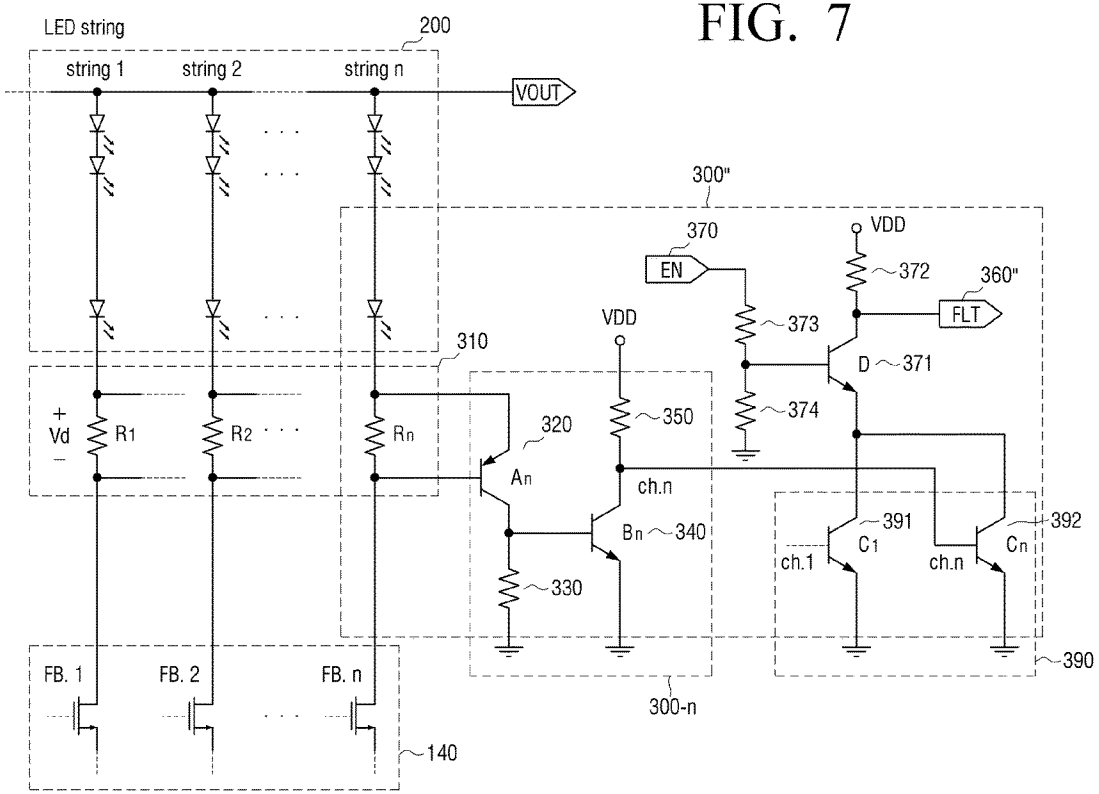
FIG. 7 is a circuit diagram illustrating a detecting unit, according to a third illustrative configuration.

FIG. 7 is a circuit diagram of a detecting unit according to a third illustrative configuration.

Referring to FIG. 7, the detecting unit 300" according to the third illustrative configuration includes a plurality of detecting circuits 300-1 to **300-*n*, where n is an integer number greater than one. Although FIG. 7 illustrates one of the detecting circuits 300-*n*, it can be appreciated that a plurality of detecting circuits 300-1 to 300-*n* may be included and may be connected in parallel. The configuration of each of the detecting circuits 300-1 to 300-*n* is similar to the illustrative configuration shown in FIG. 5. Thus, a detailed description of the detecting circuit 300-*n* is omitted. The detecting unit 300" also includes an enable circuit 370, a determination circuit 390, and an output unit 360"**.

The enable circuit 370 receives an enable signal from the controller 400 indicative of whether the detecting unit 300" will be operated. Specifically, the enable circuit 370 includes a single switching element 371 and a plurality of resistances 373, 374, and 372. Accordingly, if an enable signal is input from the controller 400, the switching element 371 is turned on.

The determination circuit 390 includes a plurality of switching elements 391 and 392, which are connected in parallel in correspondence to a number of LED arrays. Specifically, each of the switching elements 391 and 392 may be realized by an N-type BJT. An emitter of the N-type BJT is grounded, a base of the N-type BJT is operatively connected to an output end of each of the detecting circuits (that is, a base of the switching element 392 is operatively connected to the output end of the detecting circuit **300-*n*), and a collector of the N-type BJT is connected to the enable circuit 370. Although the determination circuit 390 is configured using a plurality of BJTs, the determination circuit 390** may be configured using an OR logic circuit element because the plurality of BJTs may be operated as an OR logic circuit.

If at least one of the plurality of switching elements 391 and 392 is turned off, the output unit 360" may produce output indicating that there is an open LED array. Specifically, the output unit 360" may be operatively connected to a node that is commonly connected to the switching element of the enable circuit 370 and the resistance 372. In the exemplary configuration of FIG. 7, if there is an open LED array, the output unit 360" outputs a voltage of a low electric potential (for example, 0V). Also, if all of the LED arrays are normally operating, the output unit 360" outputs a voltage of a high electric potential (for example, 5V).

The operation of the detecting unit 300" according to the third illustrative configuration will be explained below with reference to FIGS. 8 and 9.

Figure 8:
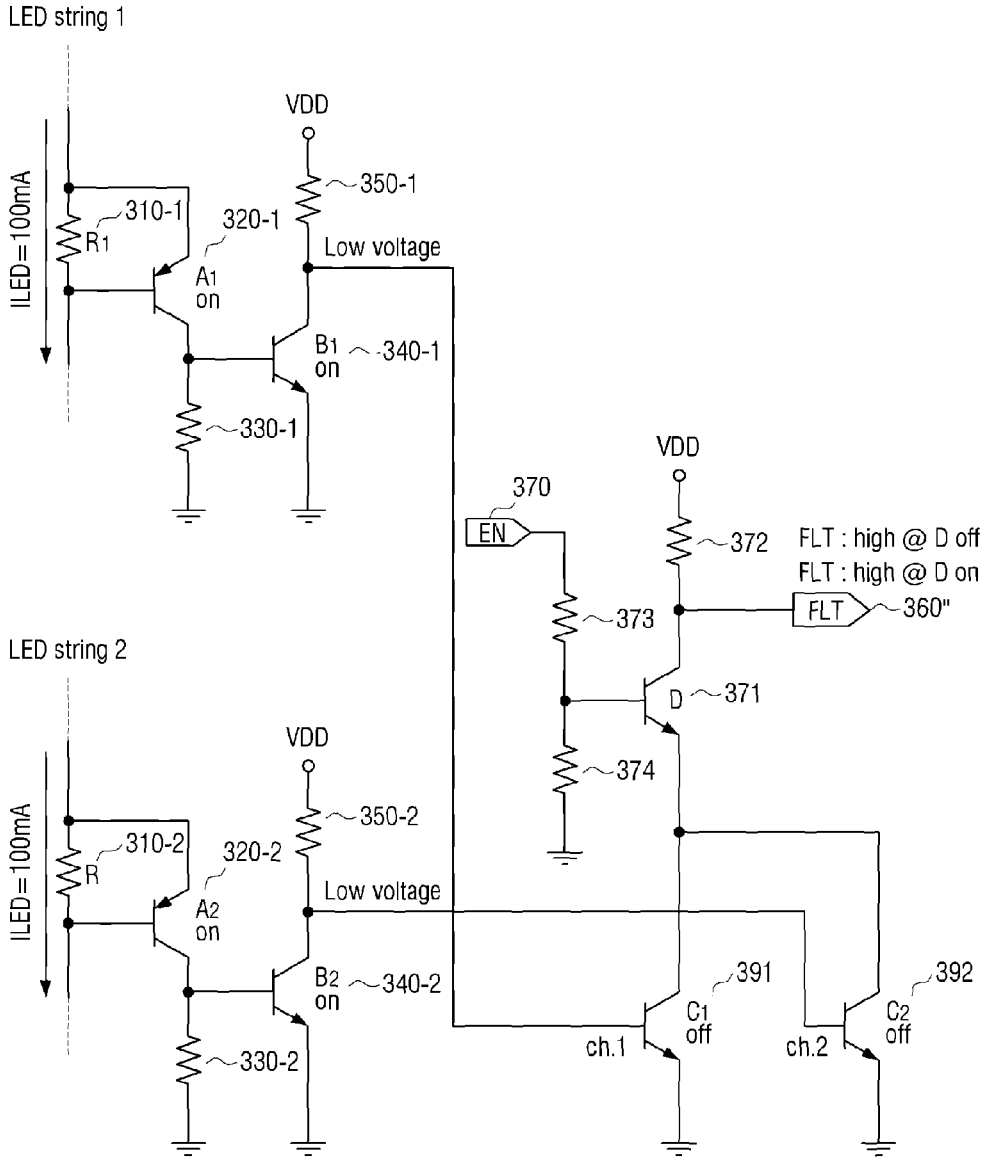
FIGS. 8 and 9 illustrate an operation of the detecting unit, according to the third illustrative configuration.
Figure 9:
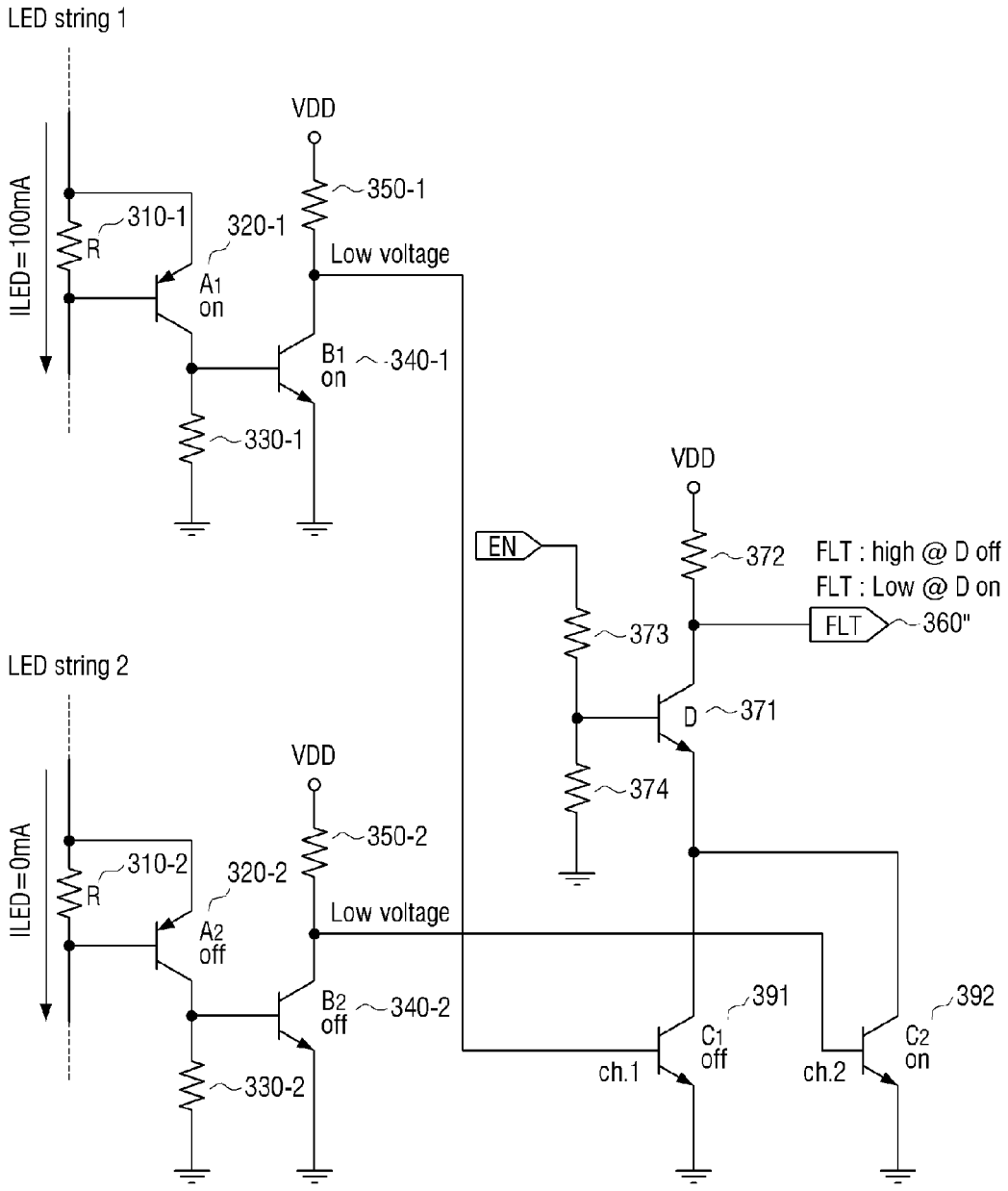

FIGS. 8 and 9 are views to explain the operation of the detecting unit 300" according to the third illustrative configuration. Specifically, FIG. 8 is illustrates the operation of the detecting unit 300" when all of the LED arrays are normally operating. FIG. 9 illustrates the operation of the detecting unit 300" when one LED array is open.

Referring to FIG. 8, when all of the LED arrays normally operating, a constant current flows through each of the LED arrays and, thus, a constant current flows through the first resistance 310-1 and 310-2. Therefore, a voltage exerted to the first resistance 310-1 and 310-2 is greater than the threshold voltage of the P-type BJTs or the first switching units 320-1 and 320-2. The first switching units 320-1 and 320-2 is turned on and a voltage of the second resistances 330-1 and 330-2, corresponding to the at least one of the first and second switching units 320-1 and 320-2, has a voltage value of a predetermined level ($V_2=R_2*I_2$). Accordingly, the N-type BJT or the second switching units 340-1 and 340-2 are turned on and the collector of the first switching units 320-1 and 320-2 has a low voltage value ($VDD-R_3*I_3$).

Also, all of the switching elements 391 and 392 of the determination circuit 370 are turned off, and, even if the switching element 371 is turned on as an enable signal is input, the collector of the switching element 371 has a high voltage value (VDD). As a result, the output unit 360 outputs a voltage of a high electric potential informing that all of the LED arrays are normally operating.

Referring to FIG. 9, one LED array is normally operating and another LED array is open and does not allow a constant current to flow therein. The operation of the detecting circuit operatively connected to the LED array that normally operates has been described with reference to FIG. 8 and, thus, an explanation is omitted.

Because a constant current does not flow in a resistance in a detecting unit 300-2 operatively connected to the opened LED array, the first switching unit 320-2 is turned off. Accordingly, the second resistance 330-2 has a voltage of 0V and, thus, the second switching unit 340-2 is turned off. Therefore, the collector of the second switching unit 340-2 has a high voltage value (VDD).

Accordingly, the switching element 391 of the switching elements 391 and 392 in the determination circuit 370 is turned off and the switching element 392 is turned on. If the switching element 371 is turned on because the enable signal is input, a current path is generated by the resistance 372, the switching element 371, and the switching element 392. Also, the collector of the switching element 371 has a low voltage value. Accordingly, the output unit 360 may output a voltage of a low electric potential informing that at least one of the LED arrays is open.

As described above, because the detecting unit 300" according to the present exemplary configuration detects whether the plurality of LED arrays are open according to whether a current flows in each of the plurality of LED arrays, the detecting unit 300" can precisely detect whether the plurality of LED arrays are open regardless of an abnormal forward voltage.

It will be understood that, although the terms first, second, third, etc. may be used herein to describe various elements, components, units and/or sections, these elements, components, units and/or sections should not be limited by these terms. These terms are only used to distinguish one element, component, unit or section from another region, layer or section. These terms do not necessarily imply a specific order or arrangement of the elements, components, regions, layers and/or sections. Thus, a first element, component, unit or section discussed below could be termed a second element, component, unit or section without departing from the teachings description of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A detecting circuit to detect whether an LED array is open, the detecting circuit comprising:

a resistance unit operatively connected in series to the LED array;

a first switching unit configured to be turned on when a voltage of the resistance unit is greater than or equal to a predetermined voltage level;

a second switching unit configured to be turned on in response to the first switching unit being turned on, and an output unit configured to produce an output indicative of whether the LED array is open, based on the first switching unit or the second switching unit.

2. The detecting circuit as claimed in claim 1, wherein the first switching unit maintains a turn-off state preventing a current from flowing when the LED array is open.

3. The detecting circuit as claimed in claim 1, wherein the first switching unit is a P-type bipolar junction transistor (BJT), wherein an emitter of the P-type BJT is commonly connected to the LED array and one end of the resistance unit, a base of the P-type BJT is operatively connected to another end of the resistance unit, and a collector of the P-type BJT is grounded through a second resistance, and wherein the predetermined voltage level is a threshold voltage of the P-type BJT.

4. The detecting circuit as claimed in claim 3, wherein a resistance value of the resistance unit is greater than or equal to a value obtained by dividing the threshold voltage of the P-type BJT by a constant current flowing through the LED array.

5. The detecting circuit as claimed in claim 3, wherein the output unit is configured to produce an output indicating whether the LED array is open based on whether the second switching unit is turned on.

6. The detecting circuit as claimed in claim 5, wherein the second switching unit is an N-type bipolar junction transistor (BJT), wherein an emitter of the N-type BJT is grounded, a base of the N-type BJT is operatively connected to the collector of the P-type BJT, and a collector of the N-type BJT is operatively connected to a voltage source through a third resistance.

7. The detecting circuit as claimed in claim 6, wherein the second resistance is disposed between the first switching unit and ground, and a resistance value of the second resistance is greater than or equal to a value obtained by dividing a threshold voltage of the N-type BJT by a current of the collector of the P-type BJT.

8. The detecting circuit as claimed in claim 7, wherein when a constant current does not flow through the LED array, current does not flow through the resistance unit, the first switching unit is turned off, the second switching unit is turned off, and the output unit is configured to output a high voltage value (VDD) indicative that the LED array is open.

9. The detecting circuit as claimed in claim 1, wherein the detecting circuit detects whether LED arrays are open, wherein the resistance unit comprises resistances operatively and respectively connected in series to the LED arrays, wherein the first switching unit comprises switching elements operatively and respectively connected to the resistances of the resistant unit, and wherein the output unit is configured to produce an output indicating that an open LED array exists when at least one of the switching elements is turned off.

10. The detecting circuit as claimed in claim 1, wherein the resistance unit is directly connected in series to the LED array.

11. The detecting circuit as claimed in claim 1, wherein the resistance unit is operatively connected at one end to the LED array and operatively connected at another end to an LED driving unit configured to adjust a level of a driving current in the LED array.

12. An LED driver apparatus, comprising:

an LED array;

an LED driving circuit configured to provide a driving voltage and a current to the LED array;

a first resistance unit operatively connected in series to the LED array;

a first switching unit configured to be turned on when a voltage of the first resistance unit is greater than or equal to a first predetermined level;

a second switching unit configured to be commonly connected to the first switching unit and a second resistance unit and to be turned on when a voltage of the second resistance unit has a voltage value of a second predetermined level; and a detecting unit configured to detect that the LED array is open when the current does not flow through the LED array and the first switching unit and the second switching unit are turned off.

13. The LED driver apparatus as claimed in claim 12, wherein the detecting unit comprises:

the first resistance unit;

the first switching unit; the second switching unit; the second resistance unit; and an output unit configured to produce an output indicating whether the LED array is open based on whether first switching unit or second switching unit is turned on.

14. The LED driver apparatus as claimed in claim 13, wherein the first switching unit maintains a turn-off state when the LED array is open and a current does not flow.

15. The LED driver apparatus as claimed in claim 13, wherein the first switching unit is a P-type bipolar junction transistor (BJT), wherein an emitter of the P-type BJT is commonly connected to the LED array and one end of the first resistance unit, a base of the P-type BJT is operatively connected to another end of the first resistance unit, and a collector of the P-type BJT is grounded through the second resistance unit, and wherein the predetermined voltage level is a threshold voltage of the P-type BJT.

16. The LED driver apparatus as claimed in claim 15, wherein a resistance value of the first resistance unit is greater than or equal to a value obtained by dividing the threshold voltage of the P-type BJT by a constant current flowing through the LED array.

17. The LED driver apparatus as claimed in claim 15, wherein the second switching unit configured to be turned on in response to the first switching unit being turned on, and wherein the output unit is configured to produce an output indicating whether the LED array is open based on whether the second switching unit is turned on.

18. The LED driver apparatus as claimed in claim 17, wherein the second switching unit is an N-type bipolar junction transistor (BJT), and wherein an emitter of the N-type BJT is grounded, a base of the N-type BJT is operatively connected to the collector of the P-type BJT, and a collector of the N-type BJT is operatively connected to a voltage source through a third resistance unit.

19. The LED driver apparatus as claimed in claim 18, wherein the second resistance unit is disposed between the first switching unit and ground, and a resistance value of the second resistance unit is greater than or equal to a value obtained by dividing a threshold voltage of the N-type BJT by a current of the collector of the P-type BJT.

20. The LED driver apparatus as claimed in claim 13, wherein the LED driver apparatus comprises LED arrays, wherein the resistance unit comprises resistances operatively and respectively connected in series to the LED arrays, wherein the first switching unit comprises-a switching elements operatively and respectively connected to the resistances of the resistant unit, and wherein the output unit is configured to produce an output indicating that an open LED array exists when at least one of the switching elements is turned off.

21. The LED driver apparatus as claimed in claim 13, further comprising:

a controller configured to stop operating the LED driving circuit when an opened LED array is detected.

* * * * *